US005829522A

United States Patent [19]

Ross et al.

[11] Patent Number: 5,829,522

[45] Date of Patent: Nov. 3, 1998

[54] SAND CONTROL SCREEN HAVING INCREASED EROSION AND COLLAPSE RESISTANCE

[75] Inventors: Colby M. Ross, Carrollton, Tex.; Anthony M. Badalamenti, Lafayette, La.

[73] Assignee: Halliburton Energy Services, Inc., Dallas, Tex.

[21] Appl. No.: 683,270

[22] Filed: Jul. 18, 1996

[51] Int. Cl.[6] ..... E03B 3/18

[52] U.S. Cl. ..... 166/228; 166/233; 166/236

[58] Field of Search ..... 166/157, 205, 166/227, 228, 231, 233, 236

[56] References Cited

U.S. PATENT DOCUMENTS

| | | | |
|---|---|---|---|
| 2,796,939 | 6/1957 | Woodruff | 166/228 |
| 3,658,128 | 4/1972 | Shobert | 166/231 |
| 4,284,138 | 8/1981 | Allred | 166/233 |
| 4,299,283 | 11/1981 | Gryskiewicz | 166/231 |
| 4,811,790 | 3/1989 | Jennings, Jr. et al. | 166/278 |
| 5,004,049 | 4/1991 | Arterbury | 166/228 |
| 5,190,102 | 3/1993 | Arterbury et al. | 166/228 |
| 5,293,935 | 3/1994 | Arterbury et al. | 166/228 |
| 5,310,000 | 5/1994 | Arterbury et al. | 166/296 |
| 5,339,895 | 8/1994 | Arterbury et al. | 166/227 |

FOREIGN PATENT DOCUMENTS

| | | | |
|---|---|---|---|
| 2269412 | 9/1994 | United Kingdom | E21B 43/08 |
| 9419578 | 9/1994 | WIPO | E21B 43/08 |

OTHER PUBLICATIONS

"Gravel Pack Systems", Otis Engineering Corporation Products and Services catalog, 1989, 1 page and 5 drawings.

*Primary Examiner*—Roger J. Schoeppel
*Attorney, Agent, or Firm*—William M. Imwalle; Paul I. Herman; Marlin R. Smith

[57] ABSTRACT

A screen provides increased erosion resistance and collapse resistance without uneconomical overcompensation and without requiring an increase in the screen's outer diameter. In a preferred embodiment, a sand control screen has a support material radially between a tubular base pipe and a filtering portion. The support material radially outwardly supports the filtering portion to help prevent radially inward collapse of the filtering portion. In another preferred embodiment, a screen has a coating applied to a filtering portion's exterior surface. The coating may alternatively or combinatively provide erosion resistance, radially inwardly retain a support material, and selectively vary flow through the filtering portion.

38 Claims, 4 Drawing Sheets

SAND CONTROL SCREEN HAVING INCREASED EROSION AND COLLAPSE RESISTANCE

BACKGROUND OF THE INVENTION

The present invention relates generally to equipment for use in subterranean wells and, in a preferred embodiment thereof, more particularly provides a sand control screen having increased erosion and collapse resistance.

Sand control screens are utilized for various purposes in subterranean wells. The name derives from their early use in preventing the production of sand along with fluids from formations. A sand control screen is typically suspended from production tubing extending to the earth's surface and positioned in a wellbore opposite a productive formation. In this way, the sand control screen may exclude the produced sand while permitting the valuable fluids to enter the tubing for transport to the earth's surface.

Other operations in which sand control screens are utilized include fracturing, gravel packing, and water flooding. In fracturing and gravel packing operations, material known as "proppant" or "gravel" is usually suspended in a slurry and pumped down the tubing and into the annular space between the sand control screen and metal casing lining the wellbore. The material typically accumulates in the annular space and eventually fills it, completely covering the exterior surface of the screen. The sand control screen prevents this material from being pumped back to the earth's surface.

In water flooding and other injection operations, fluids are pumped into the formation, for example, to generate steam in a geothermal well, to drive hydrocarbons to an upper portion of a formation, etc. The sand control screen in these cases prevents contaminants and debris from being pumped into the wellbore and formation.

When utilized to prevent production of sand from the formation, the screen is usually eroded by the flow of fluids therethrough. As the velocity of the fluid flow is increased, the rate of erosion also increases. Where the fluid flow rate from one portion of the formation is greater than the fluid flow rate from another portion of the formation, the screen will erode more quickly opposite the higher flow rate portion than it will opposite the lower flow rate portion.

Consequently, sand control screens must be designed to withstand fluid flow from the higher flow rate portion of the formation, which results in uneconomical overcompensation for the fluid flow from the lower flow rate portion of the formation. This problem is exacerbated in gas wells where it is common for a small number of perforations in the casing to have a much higher flow rate than the other perforations.

A similar, but more predictable, problem occurs in fracturing and gravel packing operations. As the material accumulates in the annular area between the screen and the casing, an increasingly large lower portion of the screen is covered with the material, restricting flow of the fluid portion of the slurry therethrough, and the flow rate of the fluid portion through the remaining upper portion of the screen not covered by the material is thereby increased. Therefore, the upper portion of a sand control screen is typically eroded much more than the lower portion during gravel packing and fracturing operations.

If the screen is designed to have very small openings, to compensate for the erosion of the upper portion during fracturing or gravel packing operations, then later, after the fracturing or gravel packing operation is completed and it is desired to produce fluids from the formation, the lower uneroded portion of the screen will have openings too small for a desired production fluid flow rate. If the screen is designed to have relatively large openings, to permit the desired production fluid flow rate after the gravel packing or fracturing operations, the upper eroded portion of the screen will have openings too large to restrict the flow of the material or sand therethrough.

Somewhat similar problems are experienced during injection operations when some portions of the formation receive the injected fluids at a greater flow rate than other portions. Also, when debris accumulates in a lower internal portion of the screen, the flow rate of the injected fluids through the upper portion of the screen is thereby increased, causing greater erosion of the screen in the upper portion.

Because of the increasingly high flow rates experienced during fracturing and gravel packing operations in recent years, screens must be designed to withstand increasingly high collapse pressures. Where a screen has very small openings, overcompensating for expected erosion of a portion of the screen, the collapse pressure for a given flow rate therethrough increases. In the past, an increased number and thickness of support rods have been used in a wire wrapped screen and increased thickness has been used in a sintered metal screen to resist increased collapse pressures. Unfortunately, each of these solutions exacerbates the problem, since each increases the resistance to flow through the screen. Each of these solutions also undesirably increases the cost and outer diameter of the screen.

From the foregoing, it can be seen that it would be quite desirable to provide a sand control screen which does not require an increased number or thickness of support rods or increased thickness of screen material for increased collapse resistance thereof, which is able to compensate for erosion during production, fracturing, gravel packing, and injection operations without overly restricting fluid flow therethrough during production, and which accomplishes these objectives economically and without increasing the outer diameter of the screen. It is accordingly an object of the present invention to provide such a sand control screen.

SUMMARY OF THE INVENTION

In carrying out the principles of the present invention, in accordance with an embodiment thereof, a screen is provided which has improved erosion resistance and collapse resistance, utilization of which permits the screen to withstand greater rates of fluid flow therethrough without requiring the screen to have an increased outer diameter.

According to a preferred embodiment of the present invention, in which a variety of unique features thereof are cooperatively combined, a screen is provided which includes a tubular base pipe and a filtering portion. The filtering portion is externally disposed relative to the base pipe and outwardly overlaps an opening formed radially through the base pipe. The filtering portion, thus, filters fluid flowing radially through the opening.

The screen also includes a support material positioned between the base pipe and the filtering portion. The support material contacts the base pipe and filtering portion and, thus, helps prevent the filtering portion from being radially inwardly collapsed by radially inwardly flowing fluid. The support material may be granular and may be held together by a resin which may be dissolvable to permit the support material, when the resin is dissolved, to flow radially inwardly through the opening, if desired.

The screen also includes a coating exteriorly applied to the filtering portion. The coating may perform one or several of many functions, including retaining the support material, preventing erosion of the filtering portion, and varying the rate of fluid flow through the filtering portion. The filtering portion may have all, or only a part, of its exterior surface covered by the coating.

In addition to the coating, or as an alternative thereto, the filtering portion may be hardened to increase its erosion resistance. Only a portion of the filtering portion may be hardened. For example, only an axial portion or an outer side surface of the filtering portion may be hardened.

The screen may also include an outer jacket and further support material between the filtering portion and the outer jacket. In that instance, the further support material may help prevent radially inward collapse of the outer jacket and radially outward expansion of the filtering portion.

The features listed above are among those provided by the disclosed preferred embodiment of the present invention. Other features will become apparent upon consideration of the detailed description set forth hereinbelow. It will be readily appreciated by one of ordinary skill in the art that these features may be utilized individually or in any combination in a screen embodying principles of the present invention.

The use of the disclosed screen enables higher rates of fluid flow in production, gravel packing, fracturing, injection, and other operations.

DETAILED DESCRIPTION

Figure 1:
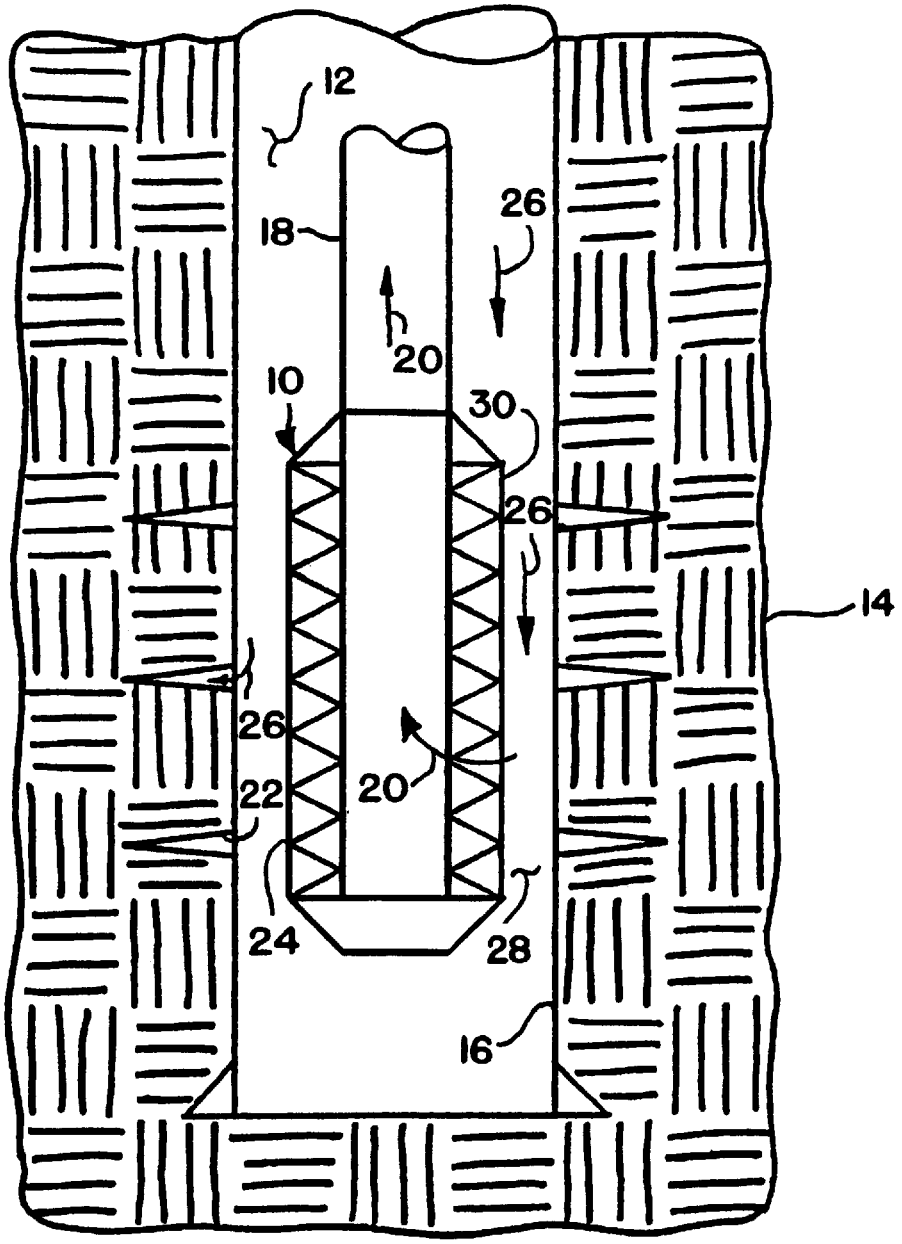
FIG. 1 PRIOR ART
FIG. 1 (Prior Art) is a highly schematicized cross-sectional view of a prior art sand control screen operatively positioned within a subterranean wellbore opposite a formation.

Illustrated in FIG. 1 is a prior art sand control screen 10 operatively positioned in a subterranean wellbore 12 opposite a formation 14 which has been lined with protective casing 16. The casing 16 has been perforated to permit fluid flow between the formation 14 and the wellbore 12. Screen 10 is suspended from production tubing 18 which extends to the earth's surface.

During production of fluids, represented by arrows 20, from the formation 14, the fluids enter the screen 10 and are transported to the earth's surface through the production tubing 18. Any sand in the fluid 20 should be filtered out by the screen 10 and not permitted to flow into the tubing 18. The screen 10 is gradually eroded over time as the fluid 20 flows through the screen. Higher rates of flow of the fluid 20 through the screen 10 cause faster erosion of the screen.

If the rate of flow of the fluid 20 through a particular perforation 22 is greater than the rate of flow of the fluid through the other perforations, as is frequently the case in gas wells, a portion 24 of the screen 10 opposite the high flow rate perforation 22 will erode faster than other portions of the screen 10. When the portion 24 of the screen 10 has eroded enough to permit sand and other debris to enter the tubing 18, the entire screen 10 must be replaced at great cost to the well operator, even though most of the screen is not yet eroded.

In gravel packing and/or fracturing operations, a slurry, represented by arrows 26, is pumped into the annular space 28 between the screen 10 and the casing 16, and into the formation 14. Fluid 20 is permitted to enter the screen 10, but proppant or gravel in the slurry 26 accumulates in the wellbore 12, gradually filling the annular space 28. As the annular space 28 is filled, the screen 10 is gradually covered, such that an increasingly smaller portion 30 of the screen is available for relatively unrestricted flow of fluids 20 therethrough. Thus, screen portion 30 experiences a higher flow rate than other portions of the screen 10 and erodes faster than other portions of the screen.

In injection operations, the above-described erosion of the screen 10 due to fracturing and/or gravel packing operations is also present, except with a reverse flow of the fluids 20 from that shown in FIG. 1. As the inside of the screen 10 fills with debris, the increasingly smaller portion 30 is available for relatively unrestricted flow therethrough of fluids 20 from inside the screen to the annular space 28. Therefore, the screen portion 30 erodes faster than other portions of the screen 10 in injection operations, also.

Figure 2:
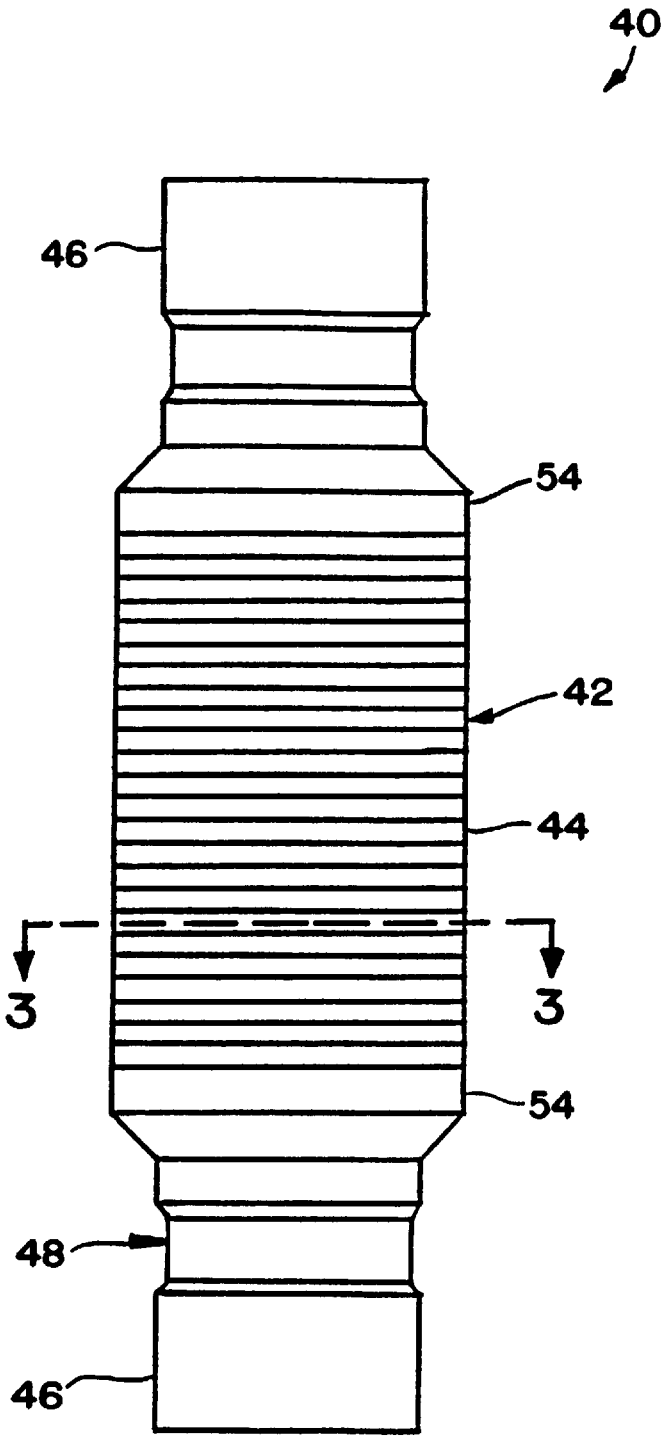
FIG. 2 is a side elevational view of a sand control screen embodying principles of the present invention.

Representatively illustrated in FIG. 2 is a sand control screen 40 embodying principles of the present invention. In the following detailed description of the embodiments of the present invention representatively illustrated in the accompanying figures, directional terms such as "upper", "lower", "upward", "downward", etc. are used in relation to the illustrated screen 40 as it is depicted in the accompanying figures. It is to be understood that the screen 40 may be utilized in vertical, horizontal, inverted, or inclined orientations without deviating from the principles of the present invention.

Screen 40 is representatively illustrated as being of the type known to those skilled in the art as a "wire wrapped" screen, due to a filtering portion 42 of the screen being made of spirally wrapped and generally triangular cross-sectioned wire 44. It is to be understood, however, that features of the present invention hereinbelow described may also be utilized in a sand control screen having a tubular filtering portion 42 made of differently shaped wire, sintered metal, or other materials, without departing from the principles of the present invention.

Screen 40 may be interconnected to tubing or other well equipment, such as tubing 18 shown in FIG. 1, by tubular end connections 46. A tubular base pipe 48 extends axially between the end connections 46 and provides an axial flow passage 50 (see FIG. 3A) for fluid flow therethrough. Preferably, the base pipe 48 has multiple axially and radially extending slots 52 (see FIG. 4) formed thereon. Base pipe 48 may also have differently configured openings, such as circular perforations, without departing from the principles of the present invention.

Screen end caps 54 are welded to opposite ends of the filtering portion 42 and to the base pipe 48. Radially inwardly directed flow through the screen 40 must, therefore, pass first through the screen portion 42, and then through the slots 52 on the base pipe 48, before entering the axial flow passage 50.

Figure 3A:
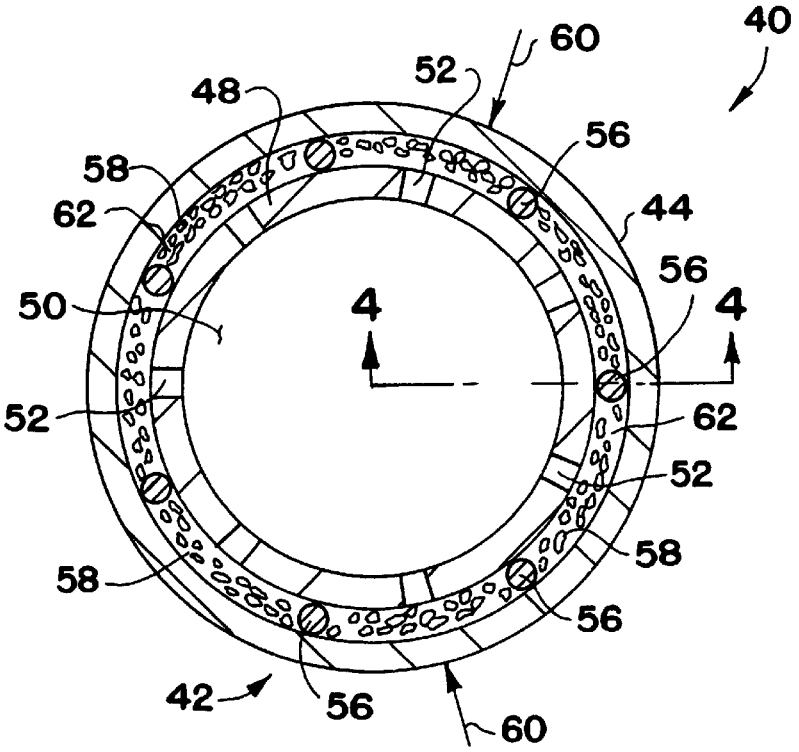
FIGS. 3A and 3B are enlarged cross-sectional views, taken along line 3—3 of FIG. 2, showing alternate constructions of the sand control screen of FIG. 2.

Referring additionally now to FIG. 3A, an enlarged cross-sectional view of the screen 40 is shown, taken along line 3—3 of FIG. 2. In this view the manner in which the wire 44 is radially outwardly spaced apart from the base pipe 48 may be clearly seen. Several (seven in the representatively illustrated embodiment) axially extending and circumferentially spaced apart rods 56 are disposed radially between the wire 44 and the base pipe 48. In a conventional manufacturing process, the wire 44 is spirally wrapped externally onto the rods 56 and welded thereto. For purposes of clarity of illustration, the wire 44 is shown as being circularly wrapped about the rods 56, but it is to be understood that the wire may have a polygonal shape due to being stretched between the rods as it is wound thereabout.

As will be readily appreciated by one skilled in the art, when fluid flows radially inward between the spirally wrapped wire 44, a radially inwardly directed force (represented by arrows 60) results, which is applied to the wire. As the flow rate is increased, the resulting force 60 is also increased. If the wire 44 is unsupported circumferentially between the rods 56, and the resulting force 60 is increased, the wire may collapse radially inwardly, resulting in the failure of the screen 40 to effectively filter the fluid flowing therethrough.

If the screen 40 is of the sintered metal type, the force 60 results from the restriction to flow therethrough of the filtering portion 42. In that case, where the filtering portion 42 is unsupported and the resulting force 60 is increased, the filtering portion 42 may break apart or crack, also resulting in the failure of the screen 40 to effectively filter the fluid flowing therethrough.

Radially between the wire 44 and the base pipe 48, and circumferentially between the rods 56, is a permeable support material 58. Preferably, the support material 58 is relatively large grain sand, but may also be ceramic proppant, spherical plastic beads, such as divinyl benzene, sintered metallic material (a generally granular-like permeable material), or other suitable material. If the support material 58 is granular, it is also preferably coated with a resin 62 to consolidate the grains. The resin 62, if used, may also be dissolvable, so that the support material 58 is permitted to flow inwardly through the slots 52 when the resin is dissolved. Use of the dissolvable resin 62 permits the support material 58 to radially outwardly support the wire 44 during high flow rate operations, such as fracturing operations, and then be removed for later, relatively low flow rate, operations wherein added flow restriction due to the support material 58 is undesirable.

It may now be fully appreciated that the support material 58, which radially outwardly supports the wire 44, permits the screen 40 to be utilized in operations wherein relatively high fluid flow rates are experienced, without collapse of the wire. Alternatively, for a given fluid flow rate, the screen 40 may have fewer supporting rods 56 and/or smaller cross-section wire 44, or thinner sintered metal filtering portion 42, than heretofore possible.

Figure 3B:
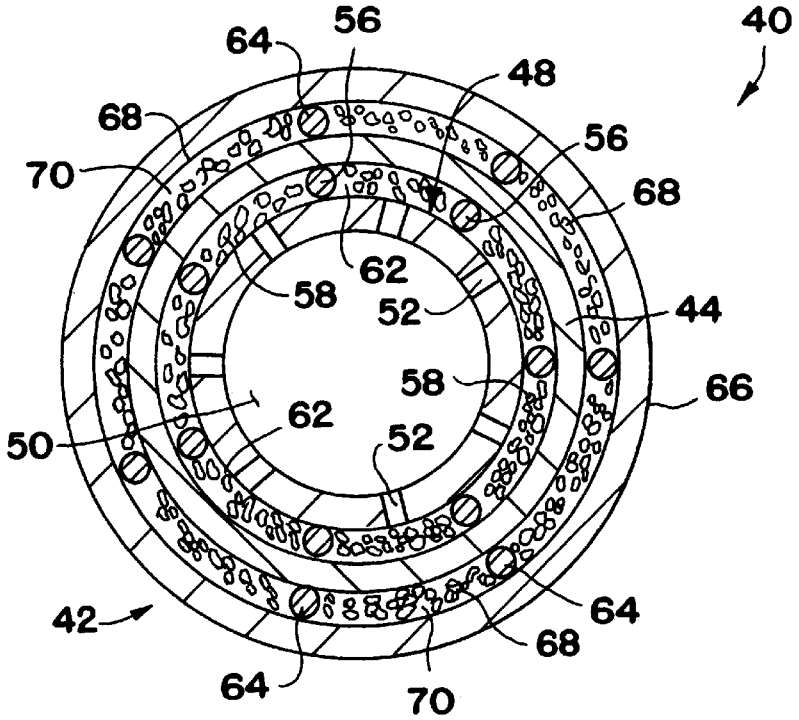

Turning now to FIG. 3B, an alternative construction of screen 40 is shown, an enlarged cross-sectional view, taken along line 3—3 of FIG. 2, being representatively illustrated. Additional axially extending and circumferentially spaced apart rods 64 are disposed radially between an outer jacket 66 and the wire 44. The outer jacket 66 may be wire, such as wire 44, it may be a slotted or perforated pipe, such as base pipe 48, or it may be made of sintered metal or other suitable material. If outer jacket 66 is made of sintered metal, or perforated or slotted pipe, rods 64 may not be utilized.

Additional permeable support material 68 is disposed radially between the outer jacket 66 and the wire 44, and circumferentially between the rods 64. Support material 68 may be made of the same material as support material 58 or may be made of different material. Support material 68 may also be coated with resin 70, which may be the same as resin 62, and which may also be dissolvable.

Outer jacket 66 is radially outwardly supported by support material 68 in a similar manner as previously described for wire 44 radially outwardly supported by support material 58. Additionally, support material 68 radially inwardly supports wire 44. Thus, where screen 40 is utilized in injection operations, such as water injection, support material 68 radially inwardly supports wire 44, helping to prevent radially outward expansion of wire 44. Note that, as previously described for wire 44, when outer jacket 66 is made of wire and is spirally wrapped about rods 64, it may have a polygonal shape instead of the representatively illustrated circular shape.

Figure 4:
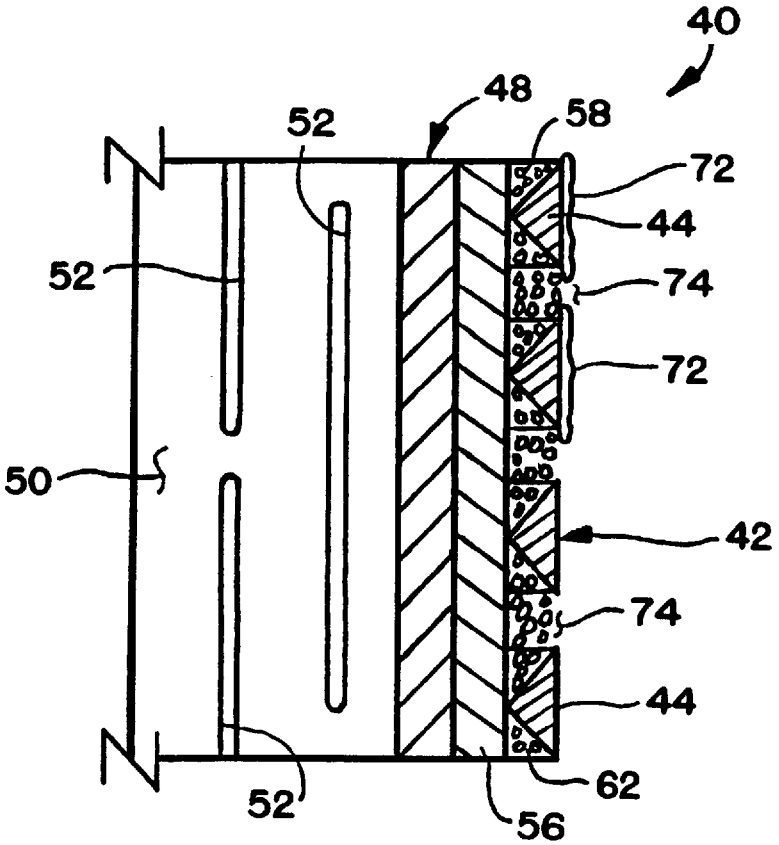
FIG. 4 is an enlarged quarter-sectional view of the sand control screen, taken along line 4—4 of FIG. 3A.

Illustrated in FIG. 4 is an enlarged quarter-sectional view of the first described embodiment of the screen 40, taken along line 4—4 of FIG. 3A. Wire 44 is shown wrapped about a rod 56, which is disposed radially between the wire 44 and the base pipe 48. The support material 58 is representatively illustrated axially between successive wraps of the wire 44, and radially between the wire 44 and the rod 56. Note that, as shown in FIG. 3A, the support material 58 is also disposed radially between the wire 44 and the base pipe 48.

The filtering portion 42, as representatively illustrated in FIG. 4, is partially exteriorly covered with a coating 72. Preferably, coating 72 is a hard and abrasion resistant material, such as flame sprayed metal, chromium, metal plasma, carbide, or other suitable material. It is to be understood that coating 72 may completely exteriorly cover filtering portion 42 without departing from the principles of the present invention. Coating 72 may be applied to the wire 44 before or after the wire is wrapped about the rods 56. For purposes of economy, applicants prefer that coating 72 be applied after the screen 40 is otherwise completely assembled.

Preferably, coating 72 axially outwardly extends from each wrap of wire 44 to which it is applied and, thus, partially closes an axial gap 74 between each wrap of wire 44. In this manner, coating 72 helps to retain the support material 58, helps prevent axial erosion of the wire 44, and provides a means of varying the axial gap 74. Where it is desired to have a relatively large flow restriction initially, and subsequently have a relatively small flow restriction through the screen 40, coating 72 may be made of a material with a desired erosion rate, such that axial gap 74 increases at a known rate as fluid flows therethrough.

As hereinabove described, it is common for one area of the filtering portion 42 to erode before other areas, such as screen portion 30 or 24 shown in FIG. 1. For purposes of economy, coating 72 may be applied only to areas of filtering portion 42 where high rates of erosion are expected. In situations where such erosion protection is desired, wire 44 may also be treated, such as by nitriding, case carburizing, induction hardening, flame hardening, or other suitable treatment.

It is contemplated that, where the filtering portion 42 is hardened, the coating 72 may or may not also be applied. Furthermore, the filtering portion 42 may or may not be completely hardened. For example, it may be desired for only outer side portions of the wire 44 to be hardened. In that case, the filtering portion 42 could be hardened by, for example, flame hardening after the screen 40 is otherwise completely assembled. Additionally, it may be desired for only certain axial portions, such as portion 30 or 24, to be hardened. Preferably, portions of the filtering portion 42 which are hardened as described above will have a hardness of at least about Rockwell b 30C.

The foregoing detailed description is to be clearly understood as being given by way of illustration and example only, the spirit and scope of the present invention being limited solely by the appended claims.

What is claimed is:

1. A screen operatively positionable within a subterranean well, the screen comprising:

a tubular base pipe having an axial flow passage, a sidewall portion, and an opening formed through the sidewall portion;

a filtering portion radially spaced apart from and circumscribing the base pipe, the filtering portion radially overlapping the sidewall portion; and an at least generally granular-like permeable inner support material disposed radially between and directly engaging opposing surface sections of the filtering portion and the sidewall portion, the inner support material conforming substantially to the filtering portion surface and radially supporting the filtering portion.

2. The screen according to claim 1, wherein the opening comprises an axially extending slot having a lateral width less than an axial length thereof, such that the sidewall portion is capable of radially outwardly supporting the inner support material.

3. The screen according to claim 1, wherein the filtering portion is tubular and is made of sintered metal, the filtering portion further being coaxially disposed relative to the base pipe.

4. The screen according to claim 1, wherein the filtering portion comprises:

a plurality of rods, the rods extending axially and being circumferentially spaced apart relative to the base pipe; and a wire having an exterior surface, the wire being spirally wound exteriorly about the rods, thereby forming a plurality of wire wraps, axially adjacent ones of the wraps being axially separated by a corresponding axial gap.

5. The screen according to claim 4, wherein the wire has a generally triangular cross-section, and wherein the wire is welded to the rods.

6. The screen according to claim 4, further comprising a coating applied to the wire exterior surface, the coating having an erosion resistance greater than an erosion resistance of the wire.

7. The screen according to claim 6, wherein the coating extends axially outwardly from the wire wraps, the coating projecting into the corresponding gaps.

8. The screen according to claim 4, further comprising a coating applied to the wire exterior surface, the coating extending axially outwardly from the wire wraps, the coating partially closing the corresponding gaps, and the coating having an erosion resistance such that the coating erodes axially inwardly toward the wire wraps to open the gaps at a desired rate.

9. The screen according to claim 1, wherein the inner support material is made of a granular material, the granular material being capable of being radially inwardly dispersed through the opening and into the flow passage.

10. The screen according to claim 9, wherein the granular material is coated with a resin, the resin being capable of consolidating the granular material.

11. The screen according to claim 10, wherein the resin is dissolvable to thereby permit the granular material to be radially inwardly dispersed through the opening when the resin is dissolved.

12. The screen according to claim 1, further comprising:

an outer jacket circumscribing the filtering portion and being radially outwardly and overlappingly disposed relative thereto; and an outer support material disposed radially between the filtering portion and the outer jacket, the outer support material being capable of radially outwardly supporting the outer jacket, and the outer support material further being capable of radially inwardly supporting the filtering portion.

13. The screen according to claim 12, wherein the outer jacket comprises a tubular member made of sintered metal, the tubular member being coaxially disposed relative to the filtering portion.

14. The screen according to claim 12, wherein the outer jacket comprises a tubular outer pipe, the outer pipe having an opening formed laterally therethrough, and the outer pipe being coaxially disposed relative to the filtering portion.

15. The screen according to claim 12, wherein the outer jacket comprises:

a plurality of rods, the rods extending axially and being circumferentially spaced apart relative to the filtering portion; and a wire having an exterior surface, the wire being spirally wound exteriorly about the rods.

16. A screen operatively positionable in a subterranean well, the screen comprising:

a tubular base pipe having an axial flow passage, a sidewall portion, and an opening formed through the sidewall portion;

a filtering portion radially spaced apart from and coaxially disposed relative to the base pipe, the filtering portion radially overlapping the sidewall portion; and an inner support material disposed radially between the filtering portion and the sidewall portion, such that no structure is radially between the inner support material and the sidewall portion, the inner support material permitting fluid flow therethrough between the filtering portion and the opening, and being complementarily shaped relative to the filtering portion in a manner substantially inhibiting pressure-created radial displacement of the filtering portion during forced fluid flow therethrough.

17. The screen according to claim 16, wherein the inner support material is selected from the group consisting of sand, ceramic proppant, and plastic beads.

18. The screen according to claim 16, further comprising a resin, the resin consolidating the inner support material.

19. A screen operatively positionable in a subterranean wellbore, the screen consisting essentially of:

a tubular base pipe having an axial flow passage and an opening formed through a sidewall portion of the base pipe;

a filtering portion radially spaced apart from and circumscribing the base pipe, the filtering portion radially outwardly overlapping the opening; and an inner support material disposed radially between the filtering portion and the opening, the inner support material being in contact with the base pipe, and the inner support material being complementarily shaped relative to the base pipe and the filtering portion, the inner support material radially outwardly supporting the filtering portion adjacent the opening.

20. The screen according to claim 19, further consisting essentially of:

an outer jacket circumscribing the filtering portion and being radially outwardly and overlappingly disposed relative thereto; and a permeable outer support material disposed radially between the filtering portion and the outer jacket, the outer support material being capable of radially outwardly supporting the outer jacket, and the outer support material further being capable of radially inwardly supporting the filtering portion.

21. The screen according to claim 20, wherein the outer jacket is a tubular member made of sintered metal, the tubular member being coaxially disposed relative to the filtering portion.

22. The screen according to claim 20, wherein the outer jacket is a tubular outer pipe, the outer pipe having an opening formed laterally therethrough, and the outer pipe being coaxially disposed relative to the filtering portion.

23. The screen according to claim 20, wherein the outer jacket has a plurality of rods, the rods extending axially and being circumferentially spaced apart relative to the filtering portion, and a wire, the wire being spirally wound exteriorly about the rods.

24. A screen operatively positionable in a subterranean well, the screen comprising:

a tubular member having opposite ends and a port extending laterally from an external surface of the tubular member to an internal surface of the tubular member, the port being disposed axially between the opposite ends;

a wire having an erosion resistance, the wire being exteriorly wound around the tubular member, the wire thereby forming an axially disposed spiral relative to the tubular member, and the spiral having an exterior surface; and a coating attached to the spiral exterior surface, the coating having an erosion resistance different from the wire erosion resistance.

25. The screen according to claim 24, wherein the coating is attached to the wire only at the spiral exterior surface.

26. The screen according to claim 24, wherein the coating is attached to less than all of the spiral exterior surface.

27. The screen according to claim 24, wherein the spiral comprises a series of axially spaced apart turns of the wire, each pair of the turns having an axial space therebetween, and wherein the coating extends axially into selected ones of the axial spaces.

28. The screen according to claim 24, wherein the coating erosion resistance is greater than the wire erosion resistance.

29. The screen according to claim 24, further comprising a permeable support material disposed laterally between the tubular member and the spiral, and wherein the spiral comprises a series of axially spaced apart turns of the wire, each pair of the turns having an axial space therebetween, and wherein the coating extends axially into selected ones of the axial spaces, the coating thereby laterally inwardly retaining the support material.

30. A screen operatively positionable in a subterranean well, the screen comprising:

a generally tubular base pipe having an opening formed through a sidewall portion thereof; and an axially extending filtering structure overlying the base pipe sidewall portion, at least a portion of the filtering structure opposite the opening being hardened.

31. The screen according to claim 30, wherein all of the filtering structure is hardened.

32. The screen according to claim 30, wherein the portion of the filtering structure comprises an axial portion of the filtering structure.

33. The screen according to claim 30, wherein the portion of the filtering structure comprises an outer side portion of the filtering structure.

34. The screen according to claim 30, wherein the portion of the filtering structure is hardened to at least about Rockwell 30C.

35. A screen operatively positionable in a subterranean well, the screen comprising:

an axially extending filtering structure having a plurality of openings extending therethrough and an erosion resistance;

a tubular structure received generally coaxially within the filtering structure; and a coating attached to at least a portion of an outer side surface of the filtering structure, and the tubular structure underlying the filtering structure being free of the coating.

36. The screen according to claim 35, wherein the coating extends axially into at least one of the openings.

37. The screen according to claim 35, wherein the coating erosion resistance is greater than the filtering structure erosion resistance.

38. A screen operatively positionable in a subterranean well, the screen comprising:

an axially extending filtering structure having a plurality of openings extending therethrough and an erosion resistance;

a coating attached to at least a portion of an outer side surface of the filtering structure;

a generally tubular member, the filtering structure overlying the tubular member; and a support material disposed between the filtering structure and the tubular member, the coating extending into at least one of the openings, the coating thereby restricting the support material from passing through the opening into which it extends.

* * * * *